US009016395B2

(12) United States Patent
Scott

(10) Patent No.: US 9,016,395 B2
(45) Date of Patent: Apr. 28, 2015

(54) IMPACT TOOL

(75) Inventor: John S. Scott, Brookfield, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 540 days.

(21) Appl. No.: 13/293,462

(22) Filed: Nov. 10, 2011

(65) Prior Publication Data

US 2012/0118596 A1 May 17, 2012

Related U.S. Application Data

(60) Provisional application No. 61/414,296, filed on Nov. 16, 2010.

(51) Int. Cl.
*B25D 15/02* (2006.01)
*B25B 21/02* (2006.01)

(52) U.S. Cl.
CPC ..... *B25B 21/026* (2013.01)

(58) Field of Classification Search
CPC ..... B25D 17/06; B25D 11/068
USPC ..... 173/98, 48, 29, 93, 104, 127, 90, 109, 173/111, 128, 132, 133; 92/239
See application file for complete search history.

(56) References Cited

U.S. PATENT DOCUMENTS 7,708,085 B2 5/2010 DeCicco et al.
7,731,616 B2 * 6/2010 Han ..... 475/207
8,286,725 B2 * 10/2012 Arich ..... 173/104
8,371,394 B2 * 2/2013 Grand ..... 173/48
2001/0031179 A1 * 10/2001 Potter et al. ..... 408/199
2005/0279519 A1 12/2005 Clark
2006/0137889 A1 * 6/2006 Hanke ..... 173/114
2006/0156860 A1 * 7/2006 Arich ..... 74/606 R
2010/0071923 A1 3/2010 Rudolph et al.
2010/0276168 A1 11/2010 Murthy et al.

FOREIGN PATENT DOCUMENTS

EP 2168724 A1 * 3/2010 ..... B25B 21/02

OTHER PUBLICATIONS

International Search Report and Written Opinion for Application No. PCT/US2011/060602 dated Aug. 29, 2012 (8 pages).
Milwaukee Electric Tool Company, M12 Cordless Lithium-Ion ¼ Hex Impact Driver 2450-22 Press Release, Sep. 2, 2008, Retrieved from Internet, Feb. 14, 2012 <URL: http://www.milwaukeetool.com/news/press-releases/9682>.
Milwaukee Electric Tool Company, M12 Cordless Lithium-Ion ¼ Hex Impact Driver 2450-20 Service Parts List, Aug. 2008, Retrieved from Internet, Feb. 10, 2012 <URL: http://www.milwaukeetool.com/CatalogItem/Attachnnents/37197_54-26/2450.pdf>.

(Continued)

*Primary Examiner* — Stephen F Gerrity
*Assistant Examiner* — Joy N Sanders
(74) *Attorney, Agent, or Firm* — Michael Best & Friedrich LLP

(57) ABSTRACT

An impact tool includes a housing, a motor supported in the housing and defining a first axis, an output shaft rotatably supported in the housing about a second axis oriented substantially normal to the first axis, and an impact mechanism coupled between the motor and the output shaft and operable to impart a striking rotational force to the output shaft.

14 Claims, 4 Drawing Sheets

(56) References Cited

OTHER PUBLICATIONS

Milwaukee Electric Tool Company, M12 Cordless Lithium-Ion Palm Nailer Kit 2458-21 Press Release, Oct. 21, 2010, Retrieved from Internet, Feb. 14, 2012 <URL: http://www.milwaukeetool.com/news/press-releases/1132>.

Milwaukee Electric Tool Company, M12 Cordless Lithium-Ion Palm Nailer Kit 2458-21, Retrieved from Internet, Feb. 10, 2012 <URL: http://www.milwaukeetool.com/ProductDetail.aspx?ProductId=2458-21>.

* cited by examiner

IMPACT TOOL

CROSS-REFERENCE TO RELATED APPLICATIONS

This application claims priority to U.S. Provisional Patent Application No. 61/414,296 filed on Nov. 16, 2010, the entire contents of which are incorporated herein by reference.

FIELD OF THE INVENTION

The present invention relates to tools, and more particularly to power tools.

BACKGROUND OF THE INVENTION

Impact tools or wrenches are typically utilized to provide a striking rotational force, or intermittent applications of torque, to a tool element and workpiece (e.g., a fastener) to either tighten or loosen the fastener. Conventional impact wrenches (i.e., either pneumatic or battery-powered) typically include a pistol grip-style housing having a handle portion grasped by the operator of the impact wrench and a motor portion extending from the handle portion. As a result of such a configuration, conventional impact wrenches are often difficult to maneuver within small work spaces.

SUMMARY OF THE INVENTION

The invention provides, in one aspect, an impact tool including a housing, a motor supported in the housing and defining a first axis, an output shaft rotatably supported in the housing about a second axis oriented substantially normal to the first axis, and an impact mechanism coupled between the motor and the output shaft and operable to impart a striking rotational force to the output shaft.

Other features and aspects of the invention will become apparent by consideration of the following detailed description and accompanying drawings.

Figure 1:
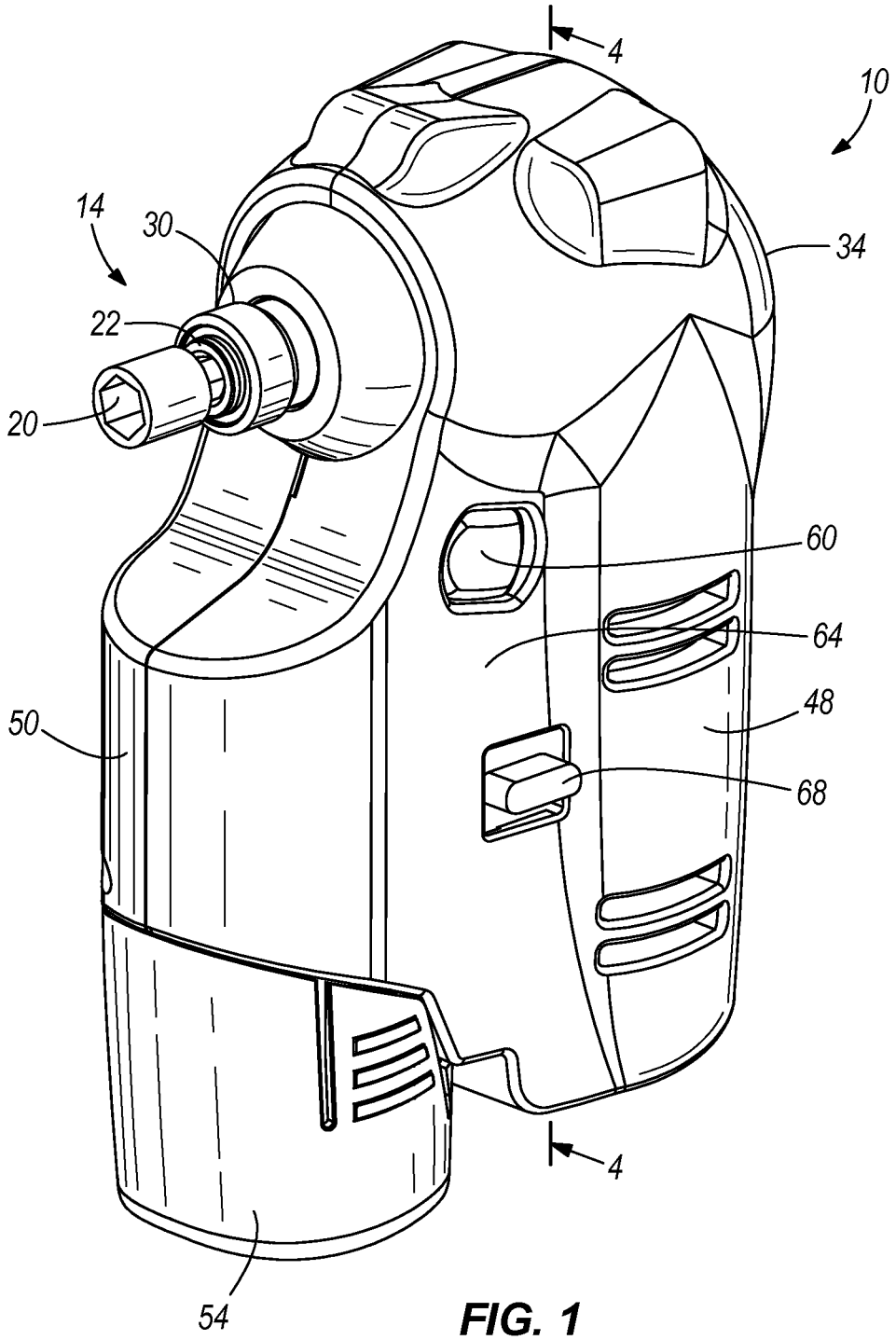
FIG. 1 is a front perspective view of an impact tool according to a construction of the invention.
Figure 2:
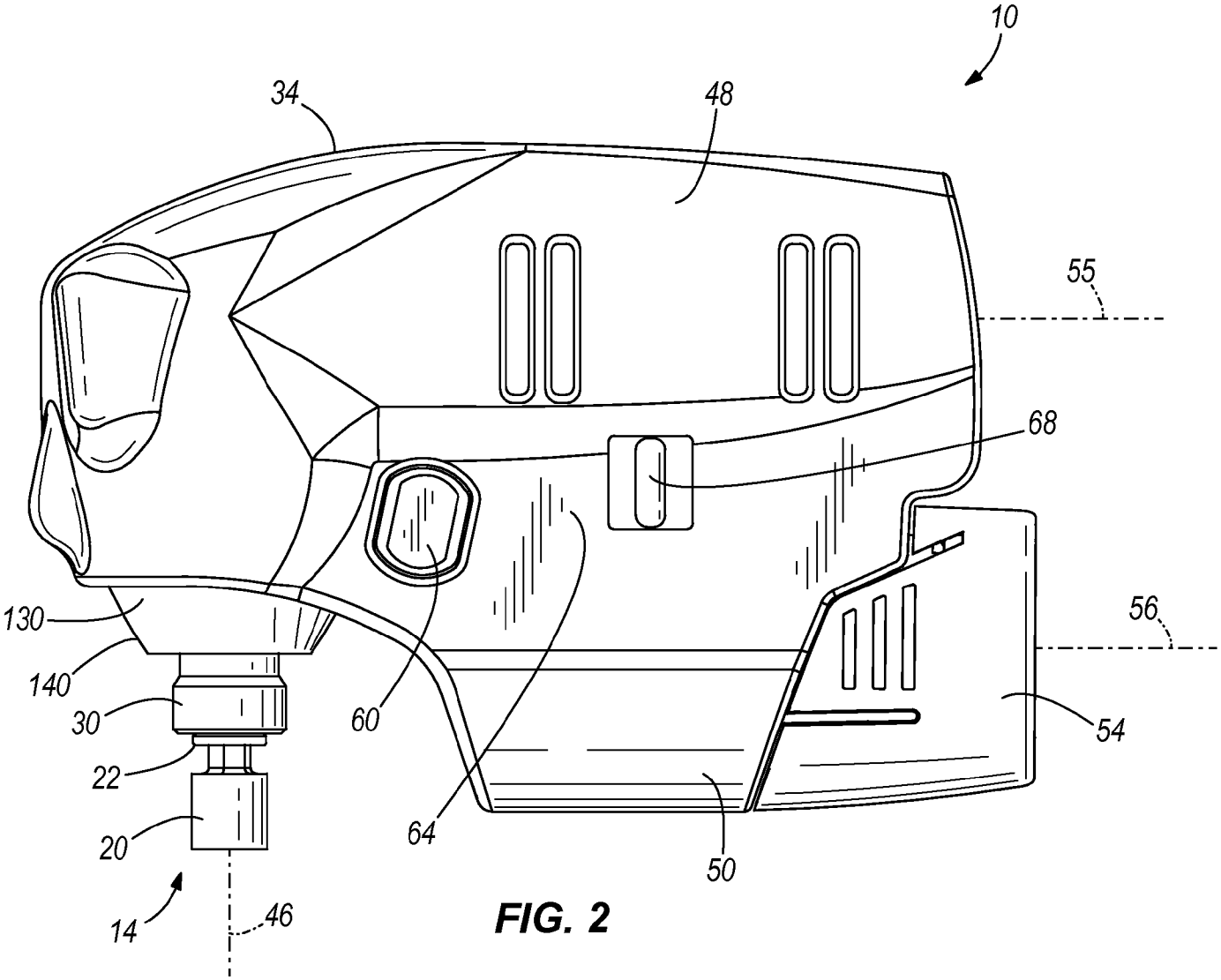
FIG. 2 is a side view of the impact tool of FIG. 1.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-4 illustrate an impact tool 10 including a drive end 14 having a non-cylindrical bore 18 (FIG. 4) within which a fastener, a tool bit, or a driver bit 20 may be received. In the illustrated construction of the tool 10, the non-cylindrical bore 18 includes a hexagonal cross-sectional shape. However, the non-cylindrical bore 18 may be shaped in any of a number of different ways to receive any of a number of different fasteners, tool bits, and/or driver bits 20. The drive end 14 includes an output shaft 22 (FIG. 3) having a detent (not shown) utilized to lock or axially secure the fastener, tool bit, and/or driver bit 20 to the drive end 14 of the tool 10, a sleeve 30 positioned over the output shaft 22 for actuating the detent between a locked and an unlocked configuration, and a biasing member (e.g., a compression spring 26) for biasing the sleeve 30 toward a position in which the detent is in the locked configuration. Alternatively, the detent, the sleeve 30, and the spring 26 may be omitted from the output shaft 22, such that the fastener, tool bit, and/or driver bit 20 is not lockable to the drive end 14 of the tool 10.

Figure 3:
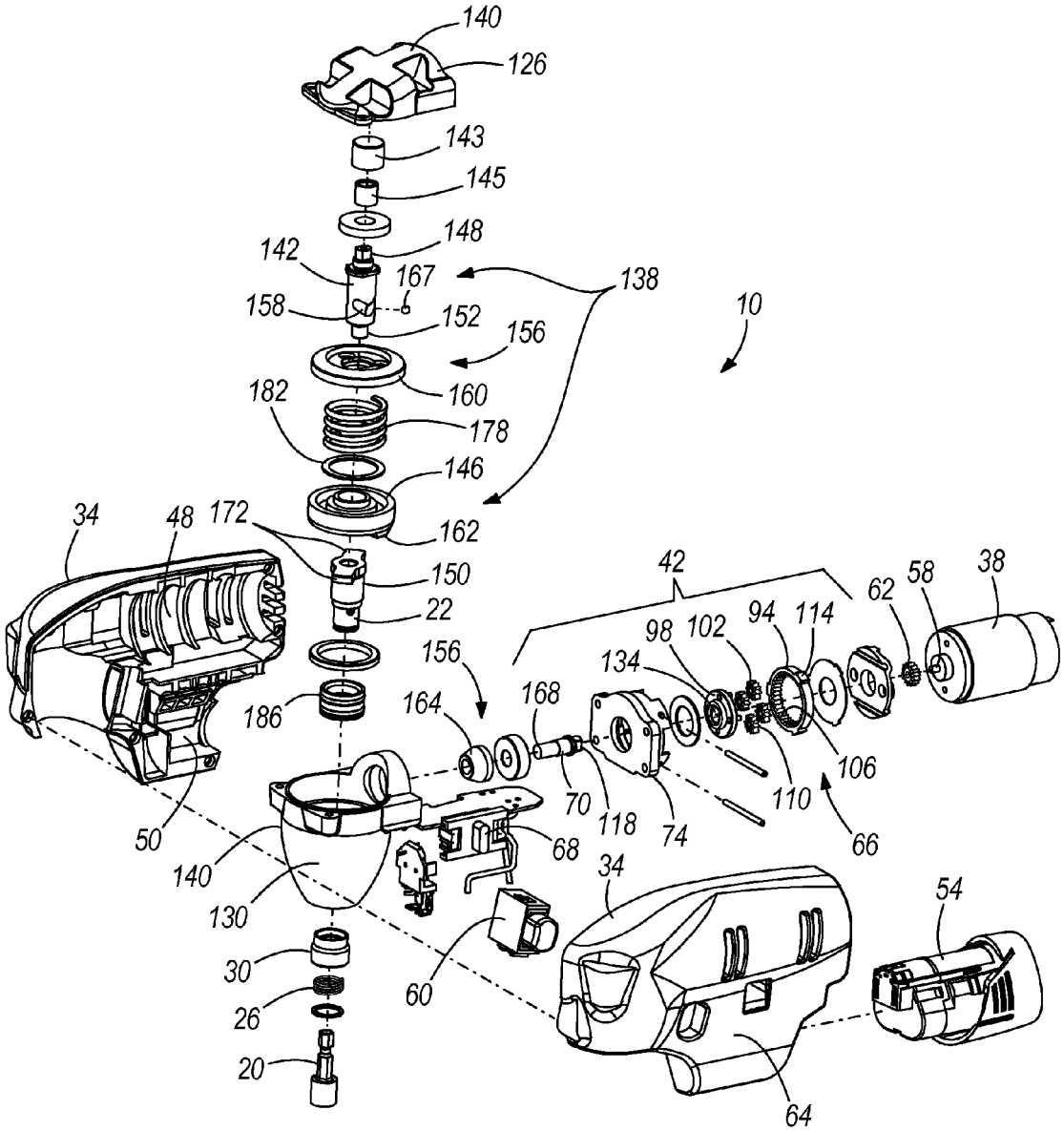
FIG. 3 is an exploded perspective view of the impact tool of FIG. 1.
Figure 4:
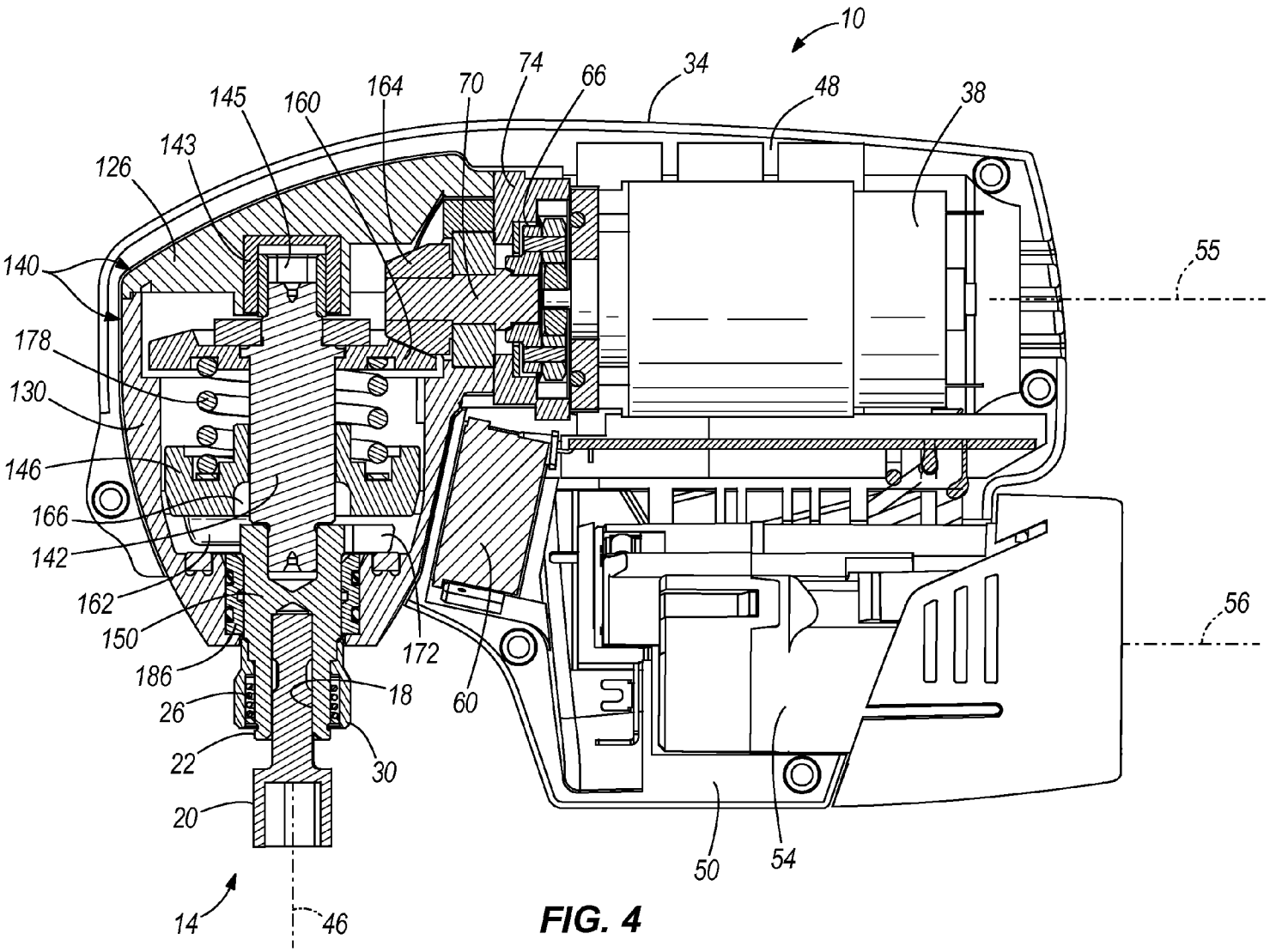
FIG. 4 is a cross-sectional view of the impact tool of FIG. 1 through line 4-4 in FIG. 1.

With reference to FIG. 4, the impact tool 10 includes a housing 34, a motor 38 supported in the housing 34, and a transmission 42 (FIG. 3) operably coupled to the motor 38 to receive torque from the motor 38. The output shaft 22 is rotatable about an axis 46 and operably coupled to the transmission 42 to receive torque from the transmission 42.

In the illustrated construction of the tool 10, the housing 34 includes a motor support portion 48 in which the motor 38 is contained, and a battery support portion 50 in which a battery pack 54 is removably received. The battery pack 54 is located directly below the motor 38 from the frame of reference of FIG. 4, such that the motor 38 and the battery pack 54 define respective parallel axes 55, 56. As is discussed below, the motor support portion 48 is grasped by the user of the tool 10 during operation. Because of the positioning of the battery pack 54 relative to the motor 38 within the housing 34, the motor 38 and the battery pack 54 substantially fit within the envelope of the user's wrist to facilitate maneuverability of the tool 10 in small work spaces. In other words, the impact tool 10 is sufficiently compact to permit the user to maneuver the tool 10 throughout the range of motion of the user's wrist without the housing 34 or the battery pack 54 interfering with the user's arm.

The battery pack 54 is electrically connected to the motor 38 via a variable-speed trigger switch 60 to provide power to the motor 38. As shown in FIG. 4, the trigger switch 60 is located on a side wall 64 of the housing 34 between the respective axes 55, 56 of the motor 38 and battery pack 54 to provide ergonomic access to the trigger switch 60 while the user is grasping the motor support portion 48 of the housing 34. The battery pack 54 is a 12-volt power tool battery pack 54 and includes three lithium-ion battery cells. Alternatively, the battery pack 54 may include fewer or more battery cells to yield any of a number of different output voltages (e.g., 14.4 volts, 18 volts, etc.). Additionally or alternatively, the battery cells may include chemistries other than lithium-ion such as, for example, nickel cadmium, nickel metal-hydride, or the like. Alternatively, the tool 10 may include an electrical cord for connecting the motor 38 to a remote electrical source (e.g., a wall outlet).

The tool 10 also includes a direction switch 68 (FIGS. 1 and 2) that is toggled between a first position, in which the motor 38 is activated to rotate the output shaft 22 in a forward (i.e., clockwise) direction, and a second position, in which the motor 38 is activated to rotate the output shaft 22 in a reverse (i.e., counter-clockwise) direction.

The motor 38 is configured as a direct-current, can-style motor 38 having a motor output shaft 58 upon which a pinion 62 is fixed for rotation (FIG. 3). In the illustrated construction of the tool 10, the pinion 62 is interference or press-fit to the motor output shaft 58. Alternatively, the pinion 62 may be coupled for co-rotation with the motor output shaft 58 in any of a number of different ways (e.g., using a spline fit, a key and keyway arrangement, by welding, brazing, using adhesives, etc.). As a further alternative, the pinion 62 may be integrally formed as a single piece with the motor output shaft 58.

With reference to FIGS. 3 and 4, the transmission 42 includes a single stage planetary transmission 66 and a transmission output shaft 70 functioning as the rotational output of the transmission 42. The transmission 42 also includes a gear case 74 within which the planetary transmission 66 is received. The gear case 74 is fixed to the motor 38 (e.g., using fasteners), and the combination of the gear case 74 and the motor 38 is clamped between the opposite halves of the housing 34 (FIG. 3).

With continued reference to FIG. 3, the planetary transmission 66 includes an outer ring gear 94, a carrier 98 rotatable about the motor axis, and planet gears 102 rotatably coupled to the carrier 98 about respective axes radially spaced from the motor axis 55. The outer ring gear 94 includes radially inwardly-extending teeth 106 that are engageable by corresponding teeth 110 on the planet gears 102. The outer ring gear 94 also includes radially outwardly-extending protrusions 114, and the gear case 74 includes corresponding slots (not shown) within which the protrusions 114 are received to rotationally fix the outer ring gear 94 to the gear case 74, and therefore the housing 34. Alternatively, the outer ring gear 94 may be fixed to the gear case 74 in any of a number of different ways (e.g., using snap-fits, an interference or press-fit, fasteners, adhesives, by welding, etc.) As a further alternative, the outer ring gear 94 may be integrally formed as a single piece with the gear case 74.

The carrier 98 includes an aperture 134 having a non-circular cross-sectional shape (e.g., a "double-D") corresponding to that of a first end 118 of the transmission output shaft 70 (FIG. 3). As such, the first end 118 of the transmission output shaft 70 is received within the aperture 134 and co-rotates with the carrier 98 at all times in response to activation of the motor 38. Alternatively, the transmission output shaft 70 may be non-rotatably coupled to the carrier 98 in any of a number of different ways.

With continued reference to FIG. 3, the tool 10 includes an impact mechanism 138 including an impact mechanism housing 140 clamped between the opposed halves of the tool housing 34 and a drive shaft 142 supported for rotation within the housing 140. In the illustrated construction of the tool 10, the housing 140 includes an upper housing portion 126 and a lower housing portion 130 interconnected to the upper housing portion 126 (e.g., using fasteners, etc.). The upper housing portion 126 includes a support 143 in which a needle bearing 145 is received (FIG. 4). A cylindrical first end 148 of the drive shaft 142 is supported by the needle bearing 145 for rotation relative to the housing 140. An opposite, second end 152 of the drive shaft 142 is piloted or supported for rotation relative to the housing 140 by the output shaft 22.

With reference to FIGS. 3 and 4, the impact tool 10 also includes a right-angle bevel gear arrangement 156 coupled between the motor 38 and the drive shaft 142. Particularly, the bevel gear arrangement 156 includes a bevel ring gear 160 coupled for co-rotation with the drive shaft 142 and a bevel pinion gear 164 engaged with the bevel ring gear 160 and coupled for co-rotation with a second end 168 of the transmission output shaft 70 (e.g., using an interference fit, a key and keyway arrangement, etc.). As shown in FIG. 4, the bevel pinion gear 164 is coaxial with the motor axis 55, and the bevel ring gear 160 is coaxial with the axis 46 of the output shaft 22. As such, the respective axes 55, 46 of the motor 38 and the output shaft 22 are oriented substantially normal to each other (i.e., at a right or 90-degree angle).

With reference to FIGS. 3 and 4, the impact mechanism 138 further includes a hammer 146 supported on the drive shaft 142 for rotation with the shaft 142, and an anvil 150 coupled for co-rotation with the output shaft 22. In the illustrated construction of the tool 10, the anvil 150 is integrally formed with the output shaft 22 as a single piece and includes opposed, radially outwardly extending lugs 172 (FIG. 3).

The shaft 142 includes two V-shaped cam grooves 158 (only one of which is shown in FIG. 3) equally spaced from each other about the outer periphery of the shaft 142. Each of the cam grooves 158 includes two segments that are inclined relative to the axis 46 in opposite directions. The hammer 146 has opposed lugs 162 and two cam grooves 166 (FIG. 4) equally spaced from each other about an inner periphery of the hammer 146. Like the cam grooves 158 in the shaft 142, each of the cam grooves 166 is inclined relative to the axis 46. The respective pairs of cam grooves 158, 166 in the shaft 142 and the hammer 146 are in facing relationship such that a cam member (e.g., a ball 167, see FIG. 3) is received within each of the pairs of cam grooves 158, 166. The balls 167 and the cam grooves 158, 166 effectively provide a cam arrangement between the shaft 142 and the hammer 146 for transferring torque between the shaft 142 and the hammer 146 between consecutive impacts of the lugs 162 upon the corresponding lugs 172 on the anvil 150. The impact mechanism 138 also includes a compression spring 178 positioned between the hammer 146 and the bevel ring gear 160 to bias the hammer 146 toward the anvil 150. A thrust bearing 182 is positioned between the hammer 146 and the spring 178 to permit relative rotation between the spring 178 and the hammer 146.

As previously discussed, the second end 152 of the drive shaft 142 is piloted or supported for rotation by the combination of the anvil 150 and the output shaft 22 (FIG. 4). The anvil 150, in turn, is supported for rotation within the impact mechanism housing 140 by a bushing 186. Alternatively, a roller bearing may be utilized in place of the bushing 186.

In operation of the tool 10, the motor support portion 48 is grasped by the user of the tool 10 during operation. Because of the positioning of the battery pack 54 relative to the motor 38 within the housing 34, the motor 38 and the battery pack 54 substantially fit within the envelope of the user's wrist to facilitate maneuverability of the tool 10 in small work spaces. Furthermore, the tool 10 may access small work spaces that would otherwise be inaccessible to conventional impact tools or impact wrenches.

During operation, the motor 38 rotates the drive shaft 142, through the transmission 42 and the bevel gear arrangement 156, in response to actuation of the trigger switch 60. The hammer 146 initially co-rotates with the drive shaft 142 and upon the first impact between the respective lugs 162, 172 of the hammer 146 and anvil 150, the anvil 150 and the output shaft 22 are rotated at least an incremental amount provided the reaction torque on the output shaft 22 is less than a predetermined amount that would otherwise cause the output shaft 22 to seize. However, should the reaction torque on the output shaft 22 exceed the predetermined amount, the output shaft 22 and anvil 150 would seize, causing the hammer 146 to momentarily cease rotation relative to the housing 140 due to the inter-engagement of the respective lugs 162, 172 on the hammer 146 and anvil 150. The shaft 142, however, continues to be rotated by the motor 38. Continued relative rotation between the hammer 146 and the shaft 142 causes the hammer 146 to displace axially away from the anvil 150 against the bias of the spring 178 in accordance with the geometry of the cam grooves 158, 166 within the respective drive shaft 142 and the hammer 146.

As the hammer 146 is axially displaced relative to the shaft 142, the hammer lugs 162 are also displaced relative to the anvil 150 until the hammer lugs 162 are clear of the anvil lugs 172. At this moment, the compressed spring 178 rebounds, thereby axially displacing the hammer 146 toward the anvil 150 and rotationally accelerating the hammer 146 relative to the shaft 142 as the balls 167 move within the pairs of cam grooves 158, 166 back toward their pre-impact position. The hammer 146 reaches a peak rotational speed, then the next impact occurs between the hammer 146 and the anvil 150. In this manner, the fastener, tool bit, and/or driver bit 20 received in the drive end 14 is rotated relative to a workpiece in incremental amounts until the fastener is sufficiently tight or loosened relative to the workpiece.

Various features of the invention are set forth in the following claims.

What is claimed is:

1. An impact tool comprising:

a housing including a motor support portion;

a motor supported in the motor support portion and defining a first axis;

an output shaft rotatably supported in the housing about a second axis oriented substantially normal to the first axis;

an impact mechanism coupled between the motor and the output shaft and operable to impart a striking force in a rotational direction to the output shaft;

a battery electrically connected to the motor and oriented along a third axis substantially parallel with the first axis; and a trigger switch located on a lateral sidewall of the housing between the first and third axes, wherein the trigger switch is configured to initiate activation of the motor in response to being depressed, wherein the trigger switch is configured to deactivate the motor in response to being released, and wherein the trigger switch is configured to be depressed in a direction generally transverse to the first axis and/or the second axis.

2. The impact tool of claim 1, wherein the battery is coupled to a battery support portion of the housing.

3. The impact tool of claim 2, wherein the battery is removably coupled to the battery support portion of the housing along the third axis.

4. The impact tool of claim 1, wherein the trigger switch is configured as variable speed trigger switch.

5. The impact tool of claim 1, wherein the impact mechanism includes an anvil rotatably supported in the housing, and a hammer coupled to the motor to receive torque from the motor and impart the striking force to the anvil.

6. The impact tool of claim 5, wherein the anvil and the hammer are each rotatable about the second axis.

7. The impact tool of claim 5, wherein the anvil is integrally formed with the output shaft as a single piece.

8. The impact tool of claim 7, wherein the impact mechanism further includes a drive shaft having a first cam groove, and a cam member at least partially received within the first cam groove and a second cam groove within the hammer, wherein the cam member imparts axial movement to the hammer relative to the drive shaft in response to relative rotation between the drive shaft and the hammer.

9. The impact tool of claim 8, further comprising a bevel gear arrangement coupled between the motor and the drive shaft, wherein the bevel gear arrangement includes a first bevel gear coupled for co-rotation with the drive shaft and a second bevel gear engaged with the first bevel gear.

10. The impact tool of claim 9, wherein the second bevel gear is coaxial with the first axis.

11. The impact tool of claim 9, further comprising a planetary transmission coupled between the motor and the second bevel gear.

12. The impact tool of claim 9, wherein the impact mechanism further includes a resilient member coupled between the hammer and the first bevel gear for biasing the hammer toward the anvil.

13. The impact tool of claim 1, wherein the motor support portion is coaxial with the first axis.

14. The impact tool of claim 1, wherein the housing includes first and second housing halves separable along a parting plane containing the second axis, one of the first and second housing halves including an aperture extending therethrough, and wherein the trigger switch is at least partially accessible through the aperture.

* * * * *